US008591063B2

(12) United States Patent
Yoneda

(10) Patent No.: US 8,591,063 B2
(45) Date of Patent: Nov. 26, 2013

(54) LED LIGHT SOURCE DEVICE

(75) Inventor: Kenji Yoneda, Kyoto (JP)

(73) Assignee: CCS Inc., Kyoto (JP)

( * ) Notice: Subject to any disclaimer, the term of this patent is extended or adjusted under 35 U.S.C. 154(b) by 238 days.

(21) Appl. No.: 13/266,354

(22) PCT Filed: Dec. 27, 2010

(86) PCT No.: PCT/JP2010/073569

§ 371 (c)(1),
(2), (4) Date: Oct. 26, 2011

(87) PCT Pub. No.: WO2011/161845

PCT Pub. Date: Dec. 29, 2011

(65) Prior Publication Data

US 2012/0188745 A1 Jul. 26, 2012

(30) Foreign Application Priority Data

Jun. 23, 2010 (JP) ..... 2010-142268

(51) Int. Cl.
*F21S 4/00* (2006.01)
*F21V 21/00* (2006.01)

(52) U.S. Cl.
USPC ..... 362/249.02; 362/294; 362/800

(58) Field of Classification Search
USPC ..... 362/249.02, 294, 800
See application file for complete search history.

(56) References Cited

U.S. PATENT DOCUMENTS

| | | | |
|---|---|---|---|
| 7,575,346 | B1 | 8/2009 | Horng et al. |
| 2010/0026185 | A1 | 2/2010 | Betsuda et al. |
| 2010/0091487 | A1 | 4/2010 | Shin |

FOREIGN PATENT DOCUMENTS

| | | | |
|---|---|---|---|
| JP | 2008204671 | A | 4/2008 |
| JP | 2008293753 | A | 4/2008 |
| JP | 2009048994 | A | 3/2009 |
| JP | 2010040221 | A | 2/2010 |
| JP | 2010092831 | A | 4/2010 |
| JP | 2010108774 | A | 5/2010 |

*Primary Examiner* — Jason Moon Han
(74) *Attorney, Agent, or Firm* — Alleman Hall McCoy Russell & Tuttle LLP

(57) ABSTRACT

The present invention is intended to thermally isolate an LED and a control part from each other to make it difficult to thermally influence each other, and also to optimize fin shapes suitable for allowable temperatures of the both respectively, and is provided with: a first housing that contains an LED board; a second housing that contains an LED control part; a connecting member that connects the first housing and the second housing to each other; a fan mechanism that is provided between the first housing and the second housing; heat dissipation fins that are provided around the fan mechanism in the first housing; and an air path of which one end opening is formed at a position facing to an air inlet side of the fan mechanism in the second housing, and the other opening is formed on a surface different from an opposed surface of the second housing.

6 Claims, 8 Drawing Sheets

Arrow ← indicates air flow.

Arrow ← indicates air flow.

LED LIGHT SOURCE DEVICE

TECHNICAL FIELD

The present invention relates to a light source device using a light emitting diode (hereinafter referred to as an LED).

BACKGROUND ART

Conventionally, as a light source device using an LED, as disclosed in Patent literature 1, there is one that is provided with: a first housing (cover part and board) that contains an LED board mounted with an LED; a second housing (circuit containing part) that contains a drive circuit part; and a retaining post that connects the first and second housings to each other. Also, in order to release heat generated from the LED to outer air, the retaining post is provided with a heat dissipation part.

However, the above-described light source device is adapted to transfer the heat from the LED to the heat dissipation part through the retaining post that connects the first and second housings to each other, and therefore the heat from the LED is transferred not only to the heat dissipation part but also to the second housing. Also, in the case where a temperature of the drive circuit part is higher than that of the LED, heat from the drive circuit part is transferred to the first housing. That is, the above-described light source device has a problem of insufficient thermal isolation between the LED and the drive circuit part.

Also, as disclosed in Patent literature 2, there is one that is provided with: a first housing (plate-like part and cover member) that contains an LED board; a second housing (lower housing) that contains a control circuit; and a third housing (housing) that connects the first and second housings to each other over their side peripheral surfaces. Also, inside the third housing, a heat dissipation member that is thermally joined to the LED board is provided, and the housing is formed with an opening part.

However, the third housing connects the side peripheral surfaces of the first and second housings throughout, and therefore there is a problem of insufficient thermal isolation. Also, the heat dissipation member is provided only on the LED board side, and heat dissipation of the second housing that contains the control circuit is not taken into account at all. Such a configuration causes the control circuit to be thermally influenced, which causes a failure or the like.

In short, these problems are caused by not recognizing a clear issue related to the need for thermal isolation in the first place.

Further, as disclosed in Patent literature 3, there is an LED lamp that is provided with a lamp housing, an LED light source, a heat sink, a control circuit, and a fan. Also, the lamp housing has a containing space, and pluralities of inlets and outlets, and in the containing space thereof, the LED light source, the heat sink, and the control circuit are arranged. Further, in the containing space, the fan is provided, and by the fan, external air flows into the containing space through the inlet, flows between heat dissipation fins of the heat sink, and then flows outward through the outlet. As described, this lamp facilitates heat dissipation from the LED light source by providing the fan in the containing space.

However, the LED light source and the control circuit are fixed to the one lamp housing, and a thermal isolation between the LED light source and the control circuit is insufficient. That is, there is a problem that heat from the LED light source transfers to the control circuit through the lamp housing.

CITATION LIST

Patent Literature

Patent literature: JPA 2008-293753
Patent literature 2: JPA 2008-204671
Patent literature 3: JPA 2009-48994

SUMMARY OF INVENTION

Technical Problem

Therefore, the present invention is one that, in order to adjust temperatures of an LED and a control part that controls the LED to optimum operating temperatures, respectively, enables the respective temperatures to be independently adjusted, and has a main desired object to thermally isolate the LED and the control part from each other to make it difficult to thermally influence each other, and also to optimize fin shapes suitable for allowable temperatures of both, respectively.

Solution to Problem

Accordingly, an LED light source device according to the present invention is provided with: a first housing that contains an LED board mounted with an LED in a substantially closed space; a second housing that contains in a substantially closed space a control part that controls the LED; a connecting part that connects the first housing and the second housing to each other and substantially thermally isolates the first housing and the second housing from each other; a fan mechanism that is provided between an opposed surface of the first housing and an opposed surface of the second housing, the opposed surfaces facing to each other, and provided such that an air inlet side faces to the second housing and an air outlet side faces outward along the opposed surfaces; an air path that has one end opening that is formed at a position facing to the air inlet side of the fan mechanism on the opposed surface of the second housing, and has another end opening that is formed on a surface different from the opposed surface of the second housing; and a plurality of heat dissipation fins that are provided around the fan mechanism on at least one of the opposed surfaces of the first housing and the second housing, wherein: the control part has a control board having a partially substantially annular shape or a substantially annular shape; the air path is formed so as to pass through a central hole of the control board; and a path-forming wall that forms the air path plays a role as a partition between a containing space that contains the control board and the air path.

If so, the LED board is contained in the first housing; the control part is contained in the second housing; and these housings are connected to each other with being substantially thermally isolated from each other, so that heat from the LED can be prevented from being easily transferred to the control part, and also heat from the control part can be prevented from being easily transferred to the LED. On the basis of such a configuration, fin shapes suitable for allowable temperatures of both are respectively optimized, and thereby the LED and the control part can be individually temperature-controlled to adjust temperatures of the LED and the control part to optimum operating temperatures, respectively.

Also, the one end opening of the air path provided in the second housing is provided at the position facing to the air inlet side of the fan mechanism, so that air can be sufficiently supplied to the fan mechanism, and also an air intake load of the fan mechanism can be reduced. Further, air flows in the second housing, and thereby the second housing and control part can also be cooled. In this case, the control board of the control part has a substantially annular shape or the like; the air path is formed so as to pass through the central hole of the control board; and the path-forming wall plays the role as the partition between the containing space that contains the control board and the air path, so that when air passes through the air path, the air draws the heat of the control part through the path-forming wall, and therefore the control part can be efficiently cooled.

Further, the path-forming wall plays the role as the partition between the containing space and the air path, and therefore a risk that dirt, dust, and the like included in air are attached to and deposited on the control part to give rise to a failure of the control part can be prevented.

In addition, the air outlet side of the fan mechanism is provided so as to face outward along the opposed surfaces, and the plurality of heat dissipation fins are provided so as to surround the fan mechanism, and therefore a sufficient amount of air can be supplied between the heat dissipation fins to thereby improve a cooling effect.

In addition, the other end opening of the air path is provided on the surface different from the opposed surface of the second housing, and therefore air that is warmed by passing between the heat dissipation fins can be prevented from flowing into the air path again.

Also, an LED light source device according to the present invention is provided with: a first housing that contains an LED board mounted with an LED; a second housing that contains a control part that controls the LED; a connecting part that connects the first housing and the second housing to each other and substantially thermally isolates the first housing and the second housing from each other; a fan mechanism that is provided between an opposed surface of the first housing and an opposed surface of the second housing, the opposed surfaces facing to each other, and provided such that an air inlet side faces outward along the opposed surfaces and an air outlet side faces to the second housing; an air path that has one end opening that is formed at a position facing to the air outlet side of the fan mechanism on the opposed surface of the second housing, and has another end opening that is formed on a surface different from the opposed surface of the second housing; and a plurality of heat dissipation fins that are provided around the fan mechanism on at least one of the opposed surfaces of the first housing and the second housing, wherein: the control part has a control board having a partially annular shape or an annular shape; the air path is formed so as to pass through a central hole of the control board; and a path-forming wall that forms the air path plays a role as a partition between a containing space that contains the control board and the air path.

If so, the LED board is contained in the first housing; the control part is contained in the second housing; and these housings are connected to each other with being substantially thermally isolated from each other, so that heat from the LED can be prevented from being easily transferred to the control part, and also heat from the control part can be prevented from being easily transferred to the LED. On the basis of such a configuration, fin shapes suitable for allowable temperatures of both are respectively optimized, and thereby the LED and the control part can be individually temperature-controlled to adjust temperatures of the LED and control part to optimum operating temperatures, respectively.

Also, the one end opening of the air path provided in the second housing is provided so as to face to the air outlet side of the fan mechanism, and the other end opening is formed on the surface different from the opposed surface of the second housing, and therefore air that is warmed by passing between the heat dissipation fins can be preferably released outward. Further, air flows in the second housing, and thereby the second housing and control part can also be cooled. In this case, the control board of the control part has a substantially annular shape or the like; the air path is formed so as to pass through the central hole of the control board; and the path-forming wall plays a role as a partition between the containing space that contains the control board and the air path, so that when air passes through the air path, the air draws the heat of the control part from the path-forming wall, and therefore the control part can be efficiently cooled.

Further, the path-forming wall plays the role as the partition between the containing space and the air path, and therefore a risk that dirt, dust, and the like included in air are attached to and deposited on the control part to give rise to a failure of the control part can be prevented.

In addition, the air inlet side of the fan mechanism is provided so as to face outward along the opposed surfaces, and the plurality of heat dissipation fins are provided so as to surround the fan mechanism, so that air that flows into the fan mechanism passes between the heat dissipation fins to draw heat, and thereby a cooling effect can be improved.

In this case, the other end opening of the air path is provided on the surface different from the opposed surface of the second housing, and therefore air that has been released outward through the air path can be prevented from flowing into the air path again from the one end opening through the heat dissipation fins.

In order to smooth air flow in the air path, and also to achieve homogeneous thermal distribution of the second housing, preferably, a plurality of other end openings of the air path are formed.

In the case of keeping the LED lit after a failure of the fan mechanism, there occurs a problem that each of the LED and the control part gives rise to heat and fails. In order to solve this problem, preferably, the LED light source device is further provided with a failure sensing part that senses a failure of the fan mechanism, wherein upon sensing of a failure of the fan mechanism by the failure sensing part, lighting of the LED is stopped.

Advantageous Effects of Invention

According to the present invention configured as described, the LED and the control part that controls the LED can be thermally isolated from each other to make it difficult to thermally influence each other, and also fin shapes suitable for allowable temperatures of both can be respectively optimized.

REFERENCE CHARACTER LIST

Figure 1:
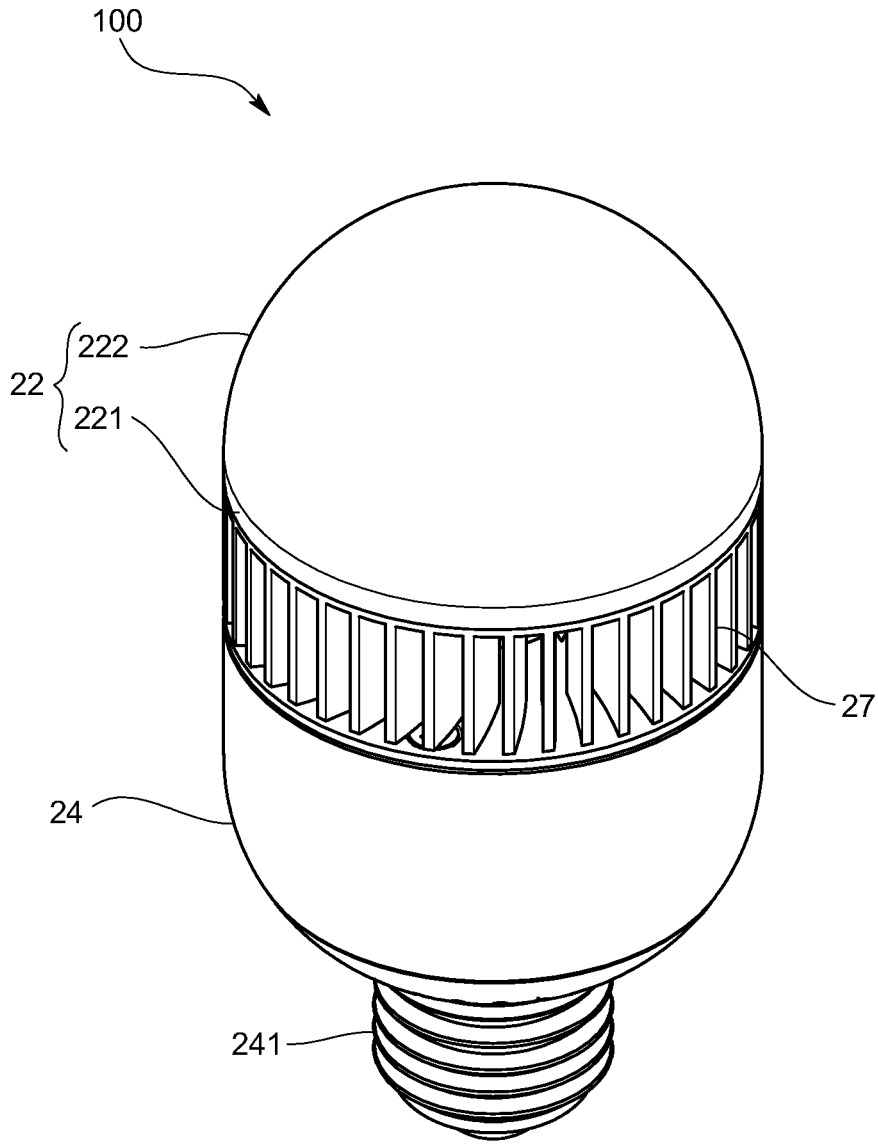
FIG. 1 is a perspective view as viewed from above an LED light source device according to one embodiment of the present invention.

100: LED light source device
211: LED
21: LED board
22: First housing
23: Control part
24: Second housing
22*a:* Opposed surface of first housing
24*a:* Opposed surface of second housing
25: Connecting member
26: Fan mechanism
26*a:* Air inlet (air inlet side)
26*b:* Air outlet (air outlet side)
27: Heat dissipation fin
28: Air path
28*a:* One end opening
28*b:* Other end opening

DESCRIPTION OF EMBODIMENTS

In the following, one embodiment of an LED light source device according to the present invention is described with reference to the drawings.

<Device Configuration>

Figure 2:
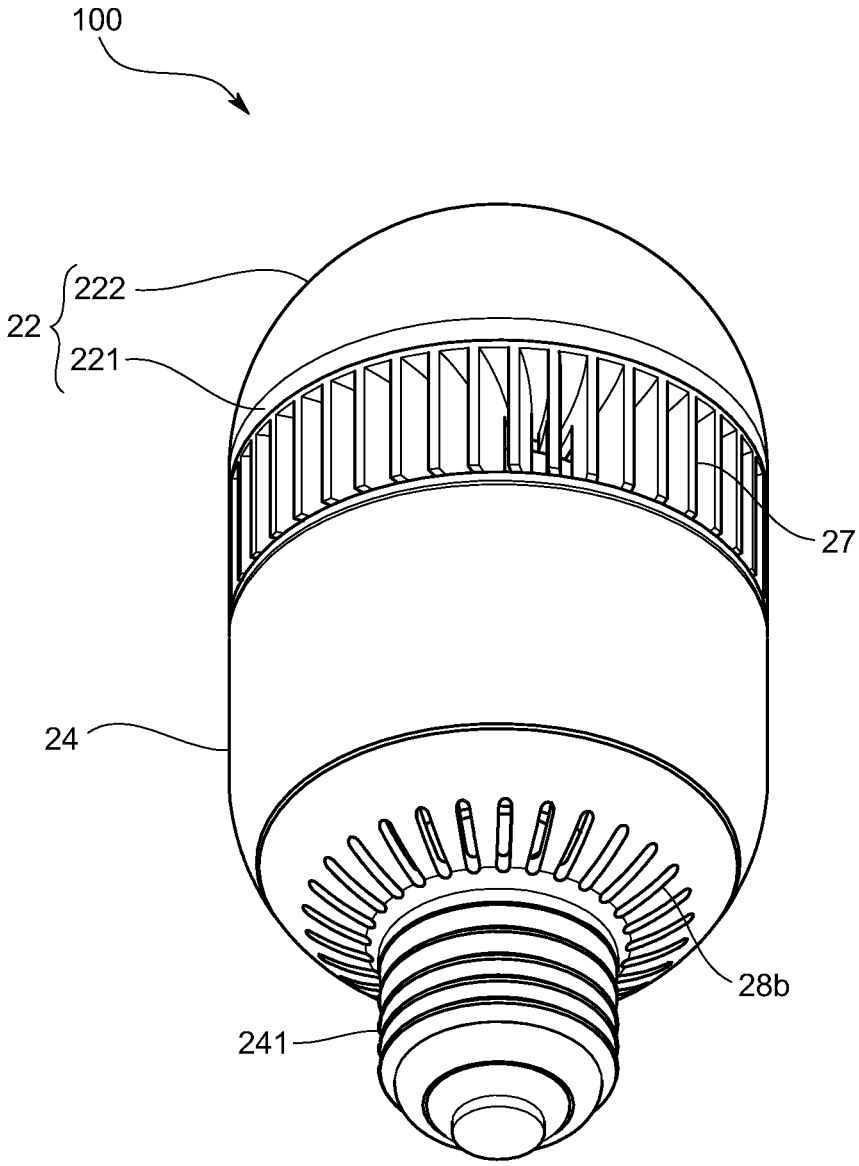
FIG. 2 is a perspective view as viewed from below the LED light source device according to the same embodiment.
Figure 3:
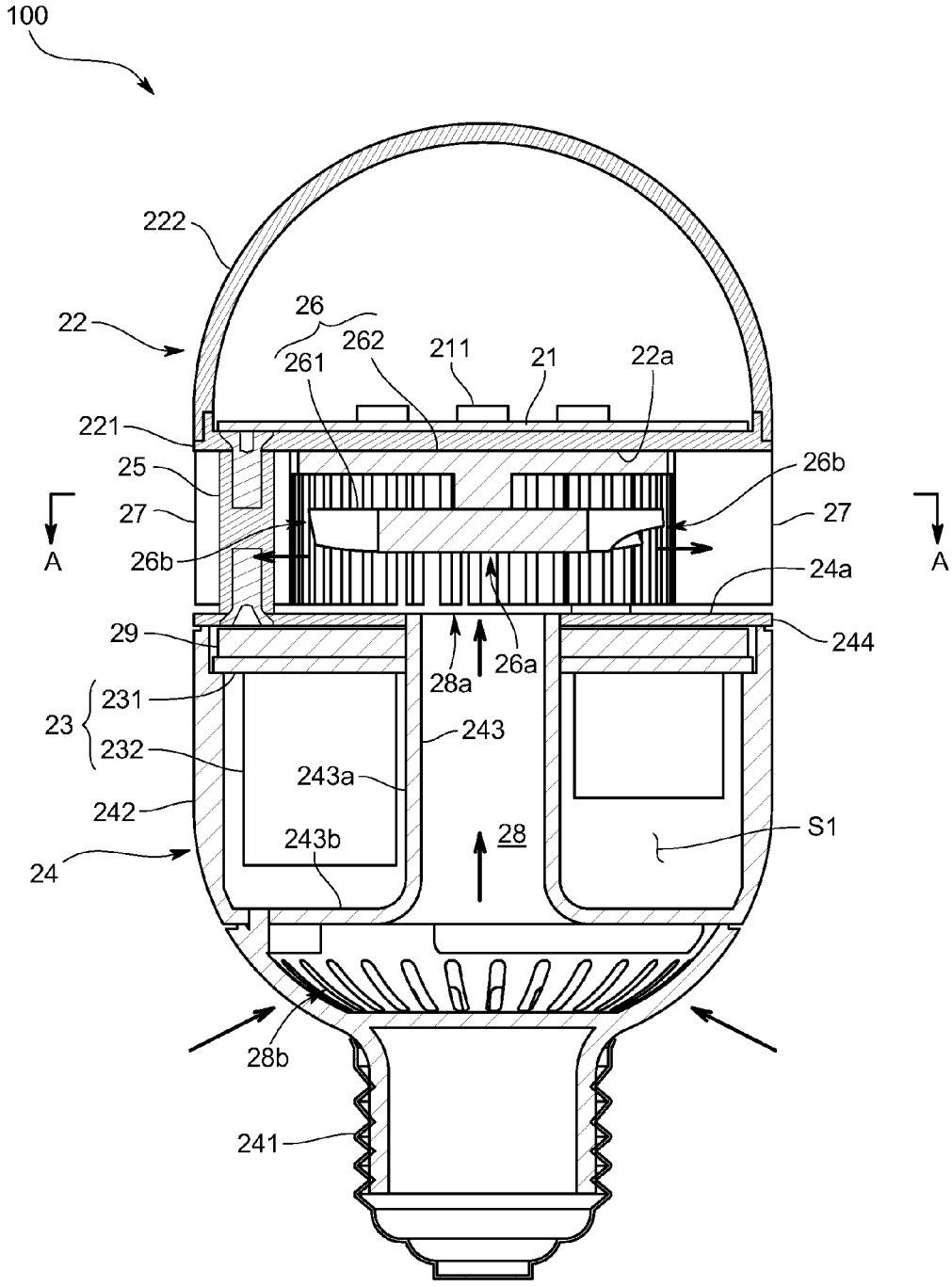
FIG. 3 is a schematic cross-sectional view of the LED light source device of the same embodiment.

An LED light source device 100 according to the present embodiment is, as illustrated in FIGS. 1 to 3, a light bulb type device having substantially a shape of a solid of revolution, and provided with: a first housing 22 that contains an LED board 21 mounted with one or more LEDs 211; a second housing 24 that contains a control part 23 that controls a voltage or the like supplied to the LEDs 211; a connecting member 25 that is provided between an opposed surface 22*a* of the first housing 22 and an opposed surface 24*a* of the second housing 24, which face to each other, and connects the first and second housings 22 and 24 to each other and substantially thermally isolates the first and second housings 22 and 24 from each other; and a fan mechanism 26 that is provided between the opposed surface 22*a* of the first housing 22 and the opposed surface 24*a* of the second housing 24, which face to each other, and provided such that an air inlet 26*a* corresponding to an air inlet side faces to the second housing, and an air outlet 26*b* corresponding to an air outlet side faces outward along the opposed surfaces 22*a* and 24*a*.

The first housing 22 is, as illustrated in FIGS. 1 to 3, one of which a fore end side has substantially a partial spherical shape, and on a rear end wall 221 of the first housing 22, the LED board 21 is provided with being in close contact with the rear end wall 221. The first housing 22 is one that contains the LED board 21 in a substantially closed space to isolate the LED board 21 from outer air. On the basis of this, the LED board 21 containing space of the first housing 22 is configured to prevent dirt, dust, and the like from outer air from intruding into the LED board 21 containing space. Specifically, regarding the LED board containing space of the first housing 22, a portion other than a wiring hole is closed. Also, a substantially partial spherical shaped part 222 of the first housing 22 is formed of a diffusing member that diffuses light from the LEDs 211. Note that a shape and a configuration of the first housing 22 are not limited to those illustrated in FIG. 2, but can be any ones of various shapes and configurations. For example, the first housing 22 may be configured to contain an LED and a condenser lens provided corresponding to the LED to emit light exiting from the condenser lens directly outward.

As illustrated in FIGS. 1 to 3, the second housing 24 has, at one end (rear end), a base part 241 that is to be connected to a socket part, and contains inside the control part 23 that controls power supplied from the base part 241 to supply it to the LEDs 211. The second housing 24 is one that contains the control part 23 in a substantially closed space to isolate the control part 23 from outer air. On the basis of this, the control part 23 containing space of the second housing 24 is configured to prevent dirt, dust, and the like from outer air from intruding into the control part containing space. Specifically, regarding the control part containing space of the second housing 24, a part other than a wiring hole is closed. In addition, in FIG. 3, wiring lines between the control part 23 and the LEDs 211 are omitted.

The connecting member 25 is, as illustrated in FIG. 3, one that is connected to the surfaces of the first and second housings 22 and 24, which face to each other, i.e., the rear end surface 22*a* of the first housing 22 and the fore end surface 24*a* of the second housing 24 to connect the first housing 22 and the second housing 24 to each other.

Figure 4:
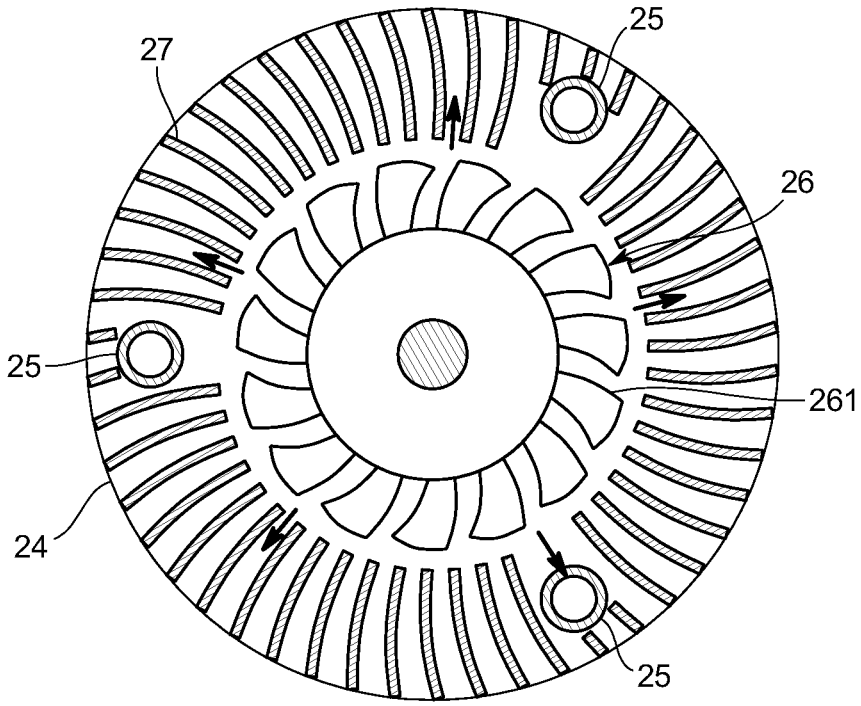
FIG. 4 is an A-A line cross-sectional view of the same embodiment.

The number of connecting members 25 of the present embodiment is three, and as illustrated in FIG. 4, the three connecting members 25 are respectively arranged so as to be positioned at apexes of an equilateral triangle, and make the connection such that the planar rear end surface 22*a* of the first housing 22 and the planar fore end surface 24*a* of the second housing are substantially parallel. By providing the plurality of connecting members 25 mutually at regular intervals as described, deviation in temperature distribution is prevented. The connecting members 25 form, between the rear end surface 22*a* of the first housing 22 and the fore end surface 24*a* of the second housing 24, a space that is opened outward. Note that, inside at least one of the connecting members 25, power source cables (not illustrated) that make connections between the control part 23 and the LEDs are wired.

The fan mechanism 26 is one that forcibly generates air flow in the space between the first and second housings 22 and 24 and also through an after-mentioned air path 28, and as illustrated in FIG. 3, between the opposed surface 22*a* of the first housing 22 and the opposed surface 24*a* of the second housing 24, which face to each other, provided in substantially the central parts of the opposed surfaces 22*a* and 24*a*. That is, the fan mechanism 26 is provided concentrically with the first housing 22 and the second housing 24. Also, the fan mechanism 26 is provided closer to a center side than the connecting members 25.

The fan mechanism 26 of the present embodiment is of a centrifugal fan type, and its air inlet 26*a* and air outlet 26*b* are provided so as to face to the second housing 24 and face outward along the opposed surfaces 22*a* and 24*a*, respectively. The fan mechanism 26 has: a rotary impeller 261 that is rotationally driven by a rotary motor (not illustrated); and a holder 262 that holds them. The holder 262 is fixed to the opposed surface 22*a* of the first housing 22 or the connecting member 25 by screws and the like.

Thus, the LED light source device 100 of the present embodiment is, as illustrated in FIGS. 3 and 4, provided with, on at least one of the opposed surface 22*a* of the first housing 22 and the opposed surface 24*a* of the second housing 24, a plurality of heat dissipation fins 27 provided around the fan mechanism 26, and on the opposed surface 24*a* of the second housing 24, the air path 28 having one end opening 28*a* that is formed at a position facing to the air inlet 26*a* of the fan mechanism 26.

In the present embodiment, it is assumed that the LEDs 211 have a higher temperature than the control part 23, and therefore the plurality of heat dissipation fins 27 are provided on the opposed surface 22*a* of the first housing 22 (see FIG. 2). The heat dissipation fins 27 are provided so as to extend from the rear end surface 22*a* of the first housing 22 toward the second housing 24. Note that the heat dissipation fins 27 are not in contact with the second housing 24.

Also, the respective heat dissipation fins 27 are, as illustrated in FIG. 4, substantially curved ones that are radially provided around the fan mechanism 26, and all of the heat dissipation fins 27 have substantially the same shape. As described, by providing the plurality of heat dissipation fins 27 so as to surround the fan mechanism 26, the fan mechanism 26 is prevented from being easily viewed in terms of appearance, and thereby without spoiling the appearance of the LED light source device 100, the fan mechanism 26 is prevented from being touched by a finger to ensure safety.

Further, the heat dissipation fins 27 are formed with use of metal having a high thermal conductivity, such as copper or aluminum. On the other hand, the connecting members 25 are formed with use of a material having a lower thermal conductivity than that of the heat dissipation fins 27, for example, a heat insulating member such as resin. On the basis of such a configuration, the first housing 22 and the second housing 24 are connected to each other by the connecting members 25 with being substantially thermal isolated from each other.

Note that, in addition to making a thermal conductivity different on the basis of the thermal conductivities of the connecting members 25 and the heat dissipation fins 27, it is also thought that by thinning the connecting members 25, as compared with a heat transfer amount transferred to the heat dissipation fins 27, a heat transfer amount transferred to the connecting members 25 is sufficiently decreased to thereby substantially thermally isolate the first and second housings 22 and 24 from each other. Alternatively, part of the connecting members 25 may be formed of a heat insulating member to achieve the thermal isolation.

Next, the air path 28 and its peripheral configuration are described.

The air path 28 provided in the second housing 24 is, as illustrated in FIG. 3, formed with the one end opening 28*a* at a position facing to the air inlet 26*a* of the fan mechanism 26 on the opposed surface 24*a* of the second housing 24, and also formed with the other end opening 28*b* on a surface different from the opposed surface 24*a* of the second housing 24. The one end opening 28*a* of the air path 28 is formed at the position corresponding to the air inlet 26*a* of the fan mechanism 26, i.e., in substantially the central part of the opposed surface 24*a* of the second housing 24 (fore end surface of the second housing 24). Also, regarding the other end opening 28*b* of the air path 28, a plurality of openings 28*b* are formed at regular intervals on the surface different from the opposed surface 24*a* of the housing 24, specifically, on an outer peripheral surface 24*b* of the second housing 24.

The second housing 24 provided with such a air path 28 has, as illustrated in FIG. 3, an outer wall 242 that has substantially a shape of a solid of revolution and is opened on a fore end side, a path-forming wall 243 that extends from an inner surface of the outer wall 242 toward the fore end side along a central axis of the outer wall 242, and a fore end wall 244 that blocks an opening formed between the outer wall 242 and the path-forming wall 243. The control part 23 is contained in the substantially annular containing space S1 that is formed among the outer wall 242, the path-forming wall 243, and fore end wall 244. The path-forming wall 243 includes: a cylindrical part 243*a* of which one end is opened on the fore end side and an inner peripheral surface has a uniform cross-sectional shape; and a flange part 243*b* that is continuous with the other end of the cylindrical part 243*a* and also continuous with an inner peripheral surface of the outer wall 242. The fore end side opening of the cylindrical part 243*a* forms the one end opening 28*a* of the air path 28. Also, on the outer wall 242 on a lower side of the flange part 243*b*, the plurality of other end openings 28*b* of the air path 28 are formed.

The control part 23 of the present embodiment includes: a control board 231 having a substantially annular shape; and a controller 232 arranged on the control board 231, in which the control board 231 is arranged substantially concentrically with the second housing 24, and its central hole is contained in the second housing 24 so as to surround the one end opening 28*a* of the air path 28. That is, the control board 231 is arranged substantially concentrically with the path-forming wall 243 so as to surround the path-forming wall 243.

The control board 231 contained in the containing space S1 is provided with being in contact with a substantially annular heat transfer member 29 that is provided with being in contact with the fore end wall 244 (wall that forms the fore end surface 24*a*) of the second housing 24. The heat transfer member 29 is formed of a material having viscoelasticity, such as silicon. Also, the heat transfer member 29 has a plan view shape that is substantially the same as a plan view shape of the control board 231. As described, by bringing the control board 231 into contact with the fore end wall 244 of the second housing 24 through the heat transfer member 29, heat of the control board 231 can be easily transferred to the fore end wall 244. Also, the heat transfer member 29 has viscoelasticity, so that regardless of irregularity that occurs due to a circuit pattern, soldering, and the like, formed on a surface of the control board 231, the control board 231 can be brought into contact with the heat transfer member 29 without any gap to more easily transfer the heat of the control board 231.

Also, the containing space S1 that contains the control part 23 is a nearly closed space that is formed by the outer wall 242, the path-forming wall 243, and the fore end wall 244, and prevents dirt, dust, and the like included in air that flows through the air path 28 from being attached to and deposited on the control part 23 to give rise to defective operation or failure of the control part 23.

Next, a heat transfer mode of the LED light source device 100 of the present embodiment is described.

Heat generated by the LEDs 211 transfers to the rear end wall 221 of the first housing 22 through the LED board 21. Note that the LED board 21 is thermally connected to the rear end wall 221 of the first housing 22. Specifically, a back surface of the LED board 21 is provided with being in surface contact with the rear end wall 221 of the first housing 22. Then, heat having transferred to the rear end wall 221 of the first housing 22 is transferred to the heat dissipation fins 27 that are provided on the rear end surface 22*a* of the first housing 22. Note that the thermal conductivity of the heat dissipation fins 27 is larger than that of the fan mechanism 26, and therefore, at this time, the heat having transferred to the rear end wall 221 of the first housing 22 is almost entirely transferred to the heat dissipation fins 27. Also, at this time, the fan mechanism 26 blows air to the heat dissipation fins 27 through the air path 28, and thereby heat transferred from the LEDs 211 to the heat dissipation fins 27 is released outward.

On the other hand, heat generated by the control part 23 transfers to the fore end wall 244 of the second housing 24 through the control board 231 and the heat transfer member 29. Then, heat having transferred to the fore end wall 244 is released outward by air that is flowed by the fan mechanism 26. Further, the heat generated by the control part 23 also transfers to the path-forming wall 243. Then, heat having transferred to the path-forming wall 243 is released outward by air that flows through the air path 28. As described, the heat generated by the control part 23 is released outward from both of the fore end wall 244 and the path-forming wall 243 of the second housing 24, and therefore the control part 23 can be preferably cooled. In this case, the path-forming wall 243 and the control board 231 are concentrically arranged, so that the heat transferring from the control board 231 to the path-forming wall 243 can be made uniform in a circumferential direction to uniformly cool the control board 231.

<Effects of the Present Embodiment>

According to the LED light source device 100 according to the present embodiment that is configured as described, the LED board 21 is contained in the first housing 22; the control part 23 is contained in the second housing 24; and these housings 22 and 24 are connected to each other with being substantially thermally isolated from each other, so that the heat from the LEDs 211 can be prevented from being easily transferred to the control part 23 and also the heat from the control part 23 can be prevented from being easily transferred to the LEDs 211. On the basis of such a configuration, by further optimizing fin shapes suitable for allowable temperatures of both, respectively, the LEDs 211 and the control part 23 can be individually temperature-controlled, and therefore temperatures of the LEDs 211 and the control part 23 can be respectively adjusted to optimum operating temperatures.

Also, the one end opening of the air path 28 provided in the second housing 24 is provided at the position facing to the air inlet 26*a* of the fan mechanism 26, so that air can be sufficiently supplied to the fan mechanism 26, and also an air intake load of the fan mechanism 26 can be reduced. Further, air flows in the second housing 24, and thereby the second housing 24 and control part 23 can also be cooled. In this case, the control board 231 of the control part 23 is substantially annular; the air path 28 is formed so as to pass through the central hole of the control board 231; and the path-forming wall plays a role as a partition between the containing space that contains the control board 231 and the air path 28, so that when air passes through the air path 28, the air draws the heat of the control part 23 from the path-forming wall, and therefore the control part 23 can be efficiently cooled.

Further, the path-forming wall plays the role as the partition between the containing space and the air path 28, and therefore a risk that dirt, dust, and the like included in air are attached to and deposited on the control part 23 to give rise to a failure of the control part 23 can be prevented.

In addition, the air outlet 26*b* of the fan mechanism 26 is provided so as to face outward along the opposed surface 22*a*, and the plurality of heat dissipation fins 27 are provided so as to surround the fan mechanism 26, and therefore a sufficient amount of air can be supplied between the heat dissipation fins 27 to improve a cooling effect.

In addition, the other end openings 28*b* of the air path 28 are provided on the surface different from the opposed surface 24*a* of the second housing 24, and therefore air that is warmed by passing between the heat dissipation fins 27 can be prevented from flowing into the air path 28 again.

<Other Variations>

Note that the present invention is not limited to the above-described embodiment.

Figure 5:
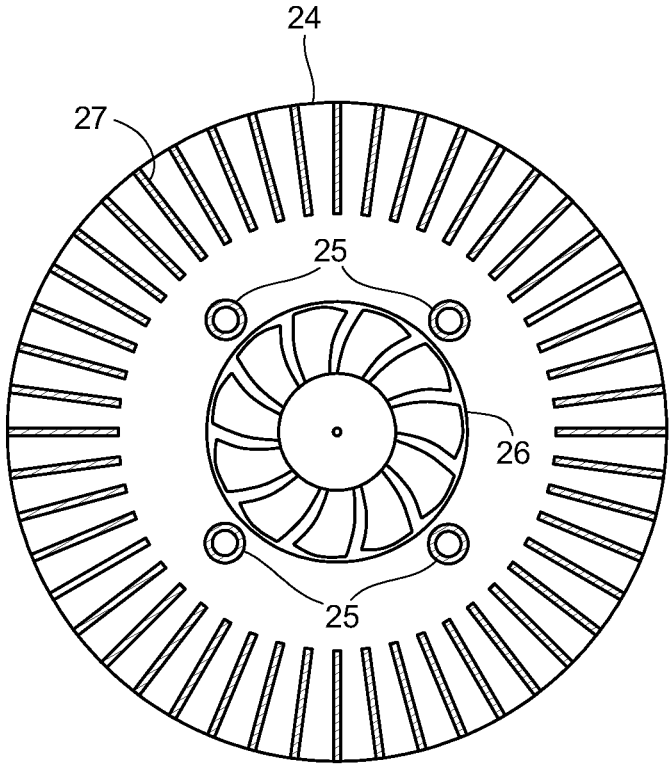
FIG. 5 is a cross-sectional view illustrating a variation of heat dissipation fins, in which an internal structure is omitted.
Figure 6:
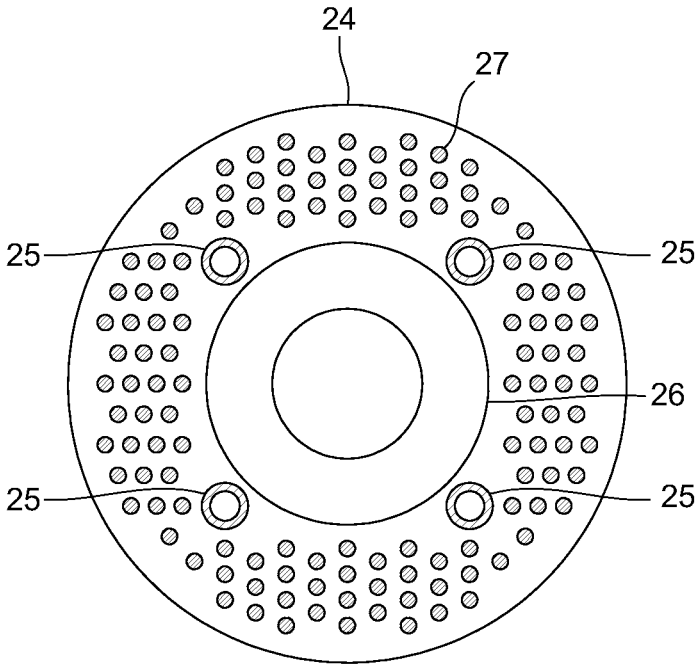
FIG. 6 is a cross-sectional view illustrating a variation of the heat dissipation fins, in which the internal structure is omitted.

For example, the heat dissipation fins may be, in addition to the curved ones that are radially arranged, as illustrated in FIG. 5, plate-like ones that are radially arranged around the fan mechanism. Also, plate-like heat dissipation fins may be arranged so as to be parallel to one another. In addition, as shown in FIG. 6, the heat dissipation fins may be formed in a straight, thin-stick shape.

Also, the above-described embodiment is configured to provide the heat dissipation fins only on the opposed surface of the first housing; however, in order to improve cooling performance of the control part, the heat dissipation fins may be provided on the opposed surface of the second housing. In order to improve cooling performance of the LEDs and control part, as illustrated in FIG. 7, the heat dissipation fins may be provided on both of the opposed surface of the first housing and the opposed surface of the second housing.

In this case, shapes of the heat dissipation fins provided on the respective opposed surfaces, such as lengths, may be determined according to a temperature balance between the LEDs and the control part. For example, in the case where a temperature of the LEDs is higher than a temperature of the control part, the heat dissipation fins of the first housing are made longer than those of the second housing. In this case, if these temperatures are largely different, the heat dissipation fins 27 of the second housing 24 may be plate-like fins that are provided on the fore end wall 244 or provided in parallel with the fore end wall 244. On the other hand, if the temperature of the control part 23 is higher than that of the LEDs 211, the heat dissipation fins of the second housing are made longer than those of the first housing. Also, if the LEDs 211 and the control part 23 have respectively comparable operating temperatures, the lengths of the first and second heat dissipation fins are made substantially the same. Further, to specifically describe this, the shape of the heat dissipation fins 27, such as a length, is determined so as to make a difference between an allowable temperature of the LEDs 211 and an actual operating temperature of the LEDs 211 and a difference between an allowable temperature of the control part 23 and an actual operating temperature of the control part 23 substantially the same.

Further, a failure sensing part that senses a failure of the fan mechanism 26 may be provided. The failure sensing part is one that, for example, detects an energization state of the motor in the fan mechanism 26 to thereby sense a failure of the fan mechanism 26, and outputs a signal of the sensing to the control part 23. Then, if the sensing signal is one that indicates a failure of the fan mechanism 26, the control part 23 having received the sensing signal stops energization of the LEDs 211 to thereby stop lighting of the LEDs 211. The failure sensing part may be arranged on the control board of the control part. If so, failures of the LEDs 211 and control part 23 caused by, after a failure of the fan mechanism 26, keeping the LEDs 211 lit to generate heat and increase temperatures respectively in the LEDs 211 and the control part 23 can be prevented.

Figure 7:
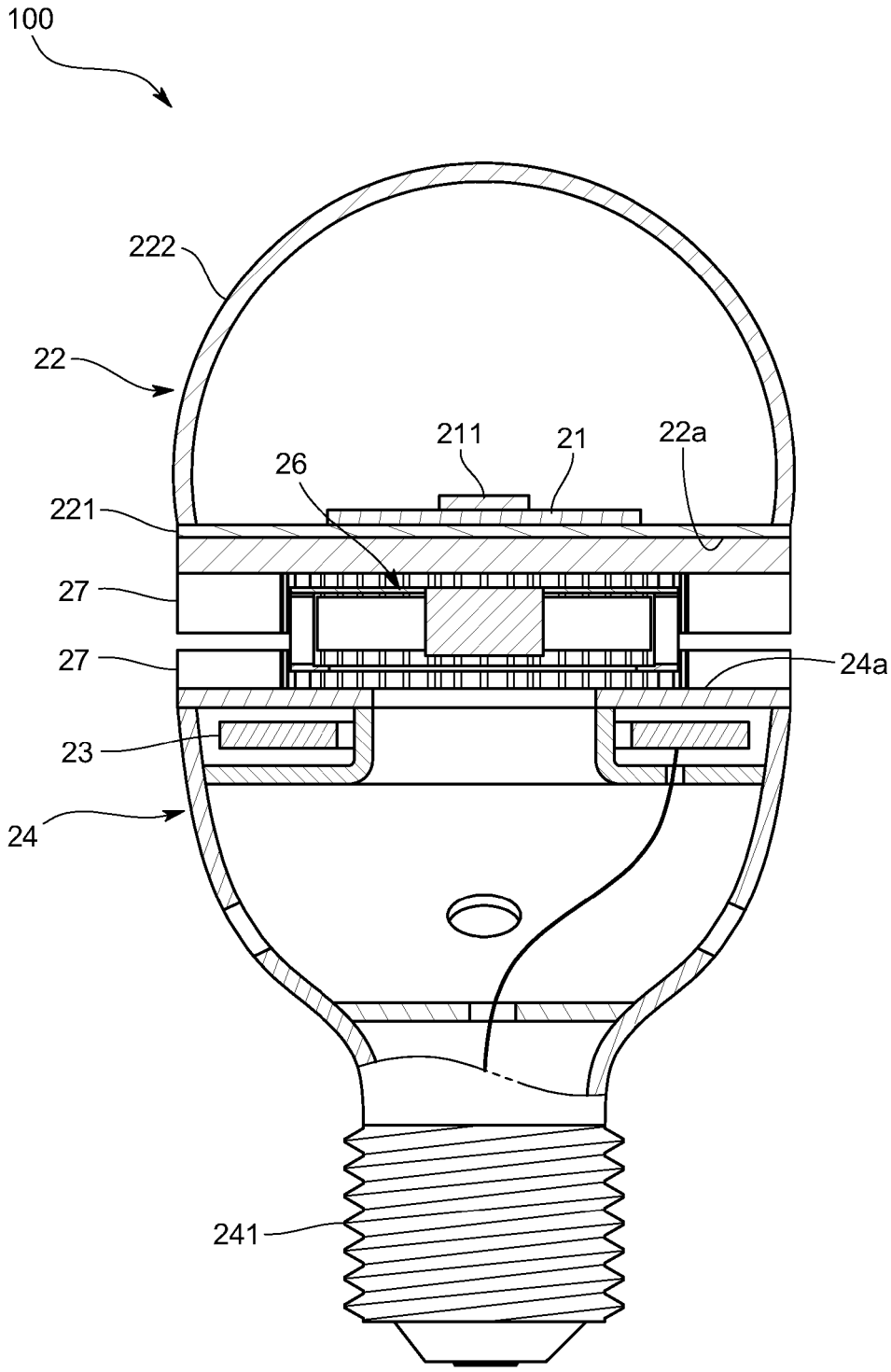
FIG. 7 is a side view schematically illustrating an LED light source device according to a variation.

In the above-described embodiment, the connecting members and the fan mechanism are respectively formed of different members; however, in addition, as illustrated in FIG. 7, the present invention may be configured to use a casing for the fan mechanism as a connecting member, and connect the first and second housings and substantially thermally isolates the first and second housings by the fan mechanism.

In addition, the fan mechanism 26 may be provided such that the air inlet 26*a* thereof faces outward along the opposed surfaces 22*a* and 24*a* and the air outlet 26*b* faces to the second housing 24. In this case, outer air passes between the heat dissipation fins 27 and is sucked by the fan mechanism 26, and then it passes through the air path 28 and flows outward again.

In addition, the opposed surfaces (rear end surface 22*a* and fore end surface 24*a*) of the first and second housings 22 and 24 of the above-described embodiment, which face to each other, are planar surfaces; however, at least one of the opposed surfaces may be a concave or convex surface.

Figure 8:
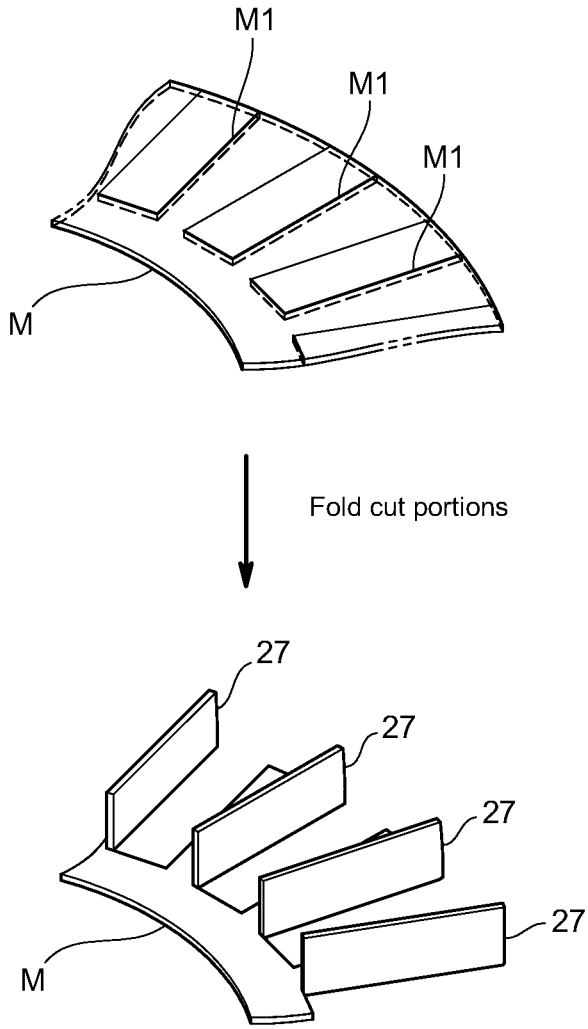
FIG. 8 is a perspective view illustrating a method for forming the heat dissipation fins.

Further, as a method for forming the heat dissipation fins 27, as illustrated in FIG. 8, the heat dissipation fins 27 may be formed by making cuts M1 in a planar fin forming member M and folding cut portions to a substantially right angle. The fin forming member M fabricated in this manner is brought into close contact with the rear end surface 22*a* of the first housing 22.

Also, without limitation to the light bulb type, a spot light type that can replace a dichroic halogen bulb is also possible.

In addition, it should be appreciated that the present invention is not limited to any of the above-described embodiments but can be variously modified without departing from the scope thereof.

INDUSTRIAL APPLICABILITY

According to the present invention, the LEDs and the control part that controls the LEDs can be thermally isolated from each other to make it difficult to thermally influence each other, and also fin shapes suitable for allowable temperatures of both can be respectively optimized.

The invention claimed is:

1. An LED light source device comprising:

a first housing that contains an LED board mounted with an LED in a substantially closed space;

a second housing that contains in a substantially closed space a control part that controls the LED;

a connecting part that connects the first housing and the second housing to each other and substantially thermally isolates the first housing and the second housing from each other;

a fan mechanism that is provided between an opposed surface of the first housing and an opposed surface of the second housing, the opposed surfaces facing to each other, and provided such that an air inlet side faces to the second housing and an air outlet side faces outward along the opposed surfaces;

an air path that has one end opening that is formed at a position facing to the air inlet side of the fan mechanism on the opposed surface of the second housing, and has the other end opening that is formed on a surface different from the opposed surface of the second housing; and a plurality of heat dissipation fins that are provided around the fan mechanism on at least one of the opposed surfaces of the first housing and the second housing, wherein:

the control part has a control board having a partially substantially annular shape or a substantially annular shape;

the air path is formed so as to pass through a central hole of the control board; and a path-forming wall that forms the air path plays a role as a partition between a containing space that contains the control board and the air path.

2. The LED light source device according to claim 1, wherein a plurality of other end openings of the air path are formed.

3. The LED light source device according to claim 1, further comprising a failure sensing part that senses a failure of the fan mechanism, wherein upon sensing of a failure of the fan mechanism by the failure sensing part, lighting of the LED is stopped.

4. The LED light source device according to claim 1, wherein the LED has: an LED element that emits ultraviolet light; and an excitation layer that is provided with covering the LED element and contains RGB phosphors.

5. The LED light source device according to claim 1, the LED light source device being a light bulb type device.

6. An LED light source device comprising:

a first housing that contains an LED board mounted with an LED;

a second housing that contains a control part that controls the LED;

a connecting part that connects the first housing and the second housing to each other and substantially thermally isolates the first housing and the second housing from each other;

a fan mechanism that is provided between an opposed surface of the first housing and an opposed surface of the second housing, the opposed surfaces facing to each other, and provided such that an air inlet side faces outward along the opposed surfaces and an air outlet side faces to the second housing;

an air path that has one end opening that is formed at a position facing to the air outlet side of the fan mechanism on the opposed surface of the second housing, and has another end opening that is formed on a surface different from the opposed surface of the second housing; and a plurality of heat dissipation fins that are provided around the fan mechanism on at least one of the opposed surfaces of the first housing and the second housing, wherein:

the control part has a control board having a partially annular shape or an annular shape;

the air path is formed so as to pass through a central hole of the control board; and a path-forming wall that forms the air path plays a role as a partition between a containing space that contains the control board and the air path.

* * * * *